US008152968B2

(12) United States Patent
Meuser

(10) Patent No.: US 8,152,968 B2
(45) Date of Patent: Apr. 10, 2012

(54) MACHINE FOR THE PRODUCTION OF A FIBROUS WEB

(75) Inventor: Günter Meuser, Kreuzau (DE)

(73) Assignee: Voith Patent GmbH, Heidenheim (DE)

( * ) Notice: Subject to any disclaimer, the term of this patent is extended or adjusted under 35 U.S.C. 154(b) by 24 days.

(21) Appl. No.: 12/871,255

(22) Filed: Aug. 30, 2010

(65) Prior Publication Data

US 2011/0005699 A1 Jan. 13, 2011

Related U.S. Application Data

(63) Continuation of application No. PCT/EP2009/056289, filed on May 25, 2009.

(30) Foreign Application Priority Data

May 29, 2008 (DE) ..... 10 2008 002 087

(51) Int. Cl.
*D21F 9/00* (2006.01)

(52) U.S. Cl. ..... 162/289; 162/266; 162/283; 162/297; 162/310; 162/350; 226/97.3

(58) Field of Classification Search ..... 162/265–266, 162/283, 289, 297, 306–310, 350; 425/80.1, 425/81.1, 83.2; 242/370; 226/97.1, 97.3
See application file for complete search history.

(56) References Cited

U.S. PATENT DOCUMENTS 2,913,365 A * 11/1959 Osborne et al. ..... 162/201
3,052,295 A * 9/1962 Magill, Jr ..... 162/314
3,785,922 A * 1/1974 Keller ..... 162/299
3,898,123 A * 8/1975 Phillips et al. ..... 162/134
3,905,067 A * 9/1975 Keib et al. ..... 162/322
4,294,655 A * 10/1981 Pfeffer ..... 162/107
6,352,947 B1 * 3/2002 Haley et al. ..... 442/364
6,451,167 B1 * 9/2002 Scheinberg ..... 162/131
6,497,787 B1 * 12/2002 Geel ..... 162/158
6,936,137 B2 * 8/2005 Moeller et al. ..... 162/193
7,311,234 B2 * 12/2007 Solberg ..... 226/97.3
7,597,779 B2 * 10/2009 Gupta et al. ..... 162/156
(Continued)

FOREIGN PATENT DOCUMENTS

EP 1346964 A2 * 9/2003
(Continued)

OTHER PUBLICATIONS

International Search Report dated Aug. 17, 2009.

*Primary Examiner* — Jose A Fortuna
(74) *Attorney, Agent, or Firm* — Taylor IP, P.C.

(57) ABSTRACT

A machine for the production of a fibrous web including a fibrous stock suspension unit for the production of an aqueous suspension, a web former for dewatering the aqueous suspension and forming the fibrous web including at least one inclined wire progressing, at least in sections, at an angle to horizontal and at least one single layer headbox, one binder wire section progressing substantially horizontally and including at least one binder headbox, one drying unit including a drying wire, one winder, and at least one blowing device positioned between the binder wire section and the drying unit for contactless floating guidance of the fibrous web by one of air and another free flowing medium, wherein the blowing device includes a plurality of blowing zones transverse to a direction of travel of the fibrous web, the blowing zones configured to be controlled/adjusted independently of each other.

24 Claims, 4 Drawing Sheets

U.S. PATENT DOCUMENTS

| | | | | |
|---|---|---|---|---|
| 2002/0148776 | A1* | 10/2002 | Cousart et al. | 210/504 |
| 2004/0224585 | A1* | 11/2004 | Grove | 442/44 |
| 2007/0012414 | A1* | 1/2007 | Kajander et al. | 162/129 |
| 2007/0039703 | A1* | 2/2007 | Lee et al. | 162/156 |
| 2007/0197114 | A1* | 8/2007 | Grove | 442/180 |
| 2008/0108266 | A1* | 5/2008 | Kajander et al. | 442/334 |
| 2009/0130416 | A1* | 5/2009 | Geel et al. | 428/220 |
| 2010/0078140 | A1* | 4/2010 | Hughes | 162/202 |
| 2010/0143684 | A1* | 6/2010 | Geel et al. | 428/220 |
| 2011/0005699 | A1* | 1/2011 | Meuser | 162/266 |

FOREIGN PATENT DOCUMENTS

| | | | |
|---|---|---|---|
| EP | 1746209 | A2 * | 1/2007 |
| SU | 1714006 | A1 * | 2/1992 |

* cited by examiner

MACHINE FOR THE PRODUCTION OF A FIBROUS WEB

CROSS REFERENCE TO RELATED APPLICATIONS

This is a continuation of PCT application No. PCT/EP2009/056289, entitled "INSTALLATION FOR PRODUCING A FIBROUS-MATERIAL WEB", filed May 25, 2009, which is incorporated herein by reference.

BACKGROUND OF THE INVENTION

1. Field of the Invention

The present invention relates to a machine for the production of a fibrous web, for example a long-fiber paper web or a wet-laid nonwoven web.

2. Description of the Related Art

Machines for the production of a fibrous web, especially a long-fiber or wet-laid nonwoven web and applicable methods to produce the webs, the so-called wet processes, are known in the state of the art. In this wet process, a fiber glass slurry is produced and allocated to a white water stream by adding glass fiber having a fiber length in the range of 6 to 40 mm, preferably 8 to 30 mm, especially 10 to 25 mm to a typical white water in a pulper for dispersion of the glass fiber in the white water by creating the fiber glass slurry having a fiber concentration of approximately 0.2 to 1.0 weight percent. In a sheet forming unit comprising at least one single layer, for example multi-layer, headbox this fiber glass slurry is then brought onto an inclined wire which extends, at least in sections, at an angle to the horizontal, and is dewatered. By dewatering the fiber glass slurry, a fiber glass wet-laid nonwoven material is formed. The formed fiber glass wet-laid nonwoven is then transferred to a binder wire which—at least in segments—is running horizontally or approximately horizontally in a binder wire section. In this binder wire section at least one aqueous binding agent, for example urea-formaldehyde (UF)-resin based binder, is brought onto the wet fiber glass wet-laid nonwoven by means of at least one binder headbox. The surplus binding agent is subsequently sucked off. The aqueous binding agent solution is applied onto the wet fiber glass wet-laid nonwoven by means of a curtain coater or a dip and squeeze applicator. However, other application methods such as spraying are also suitable. The wet fiber glass wet-laid nonwoven that is not yet conglutinated is then transferred into a drying unit including a drying wire for drying and hardening (polymerization) of the binding agent which conglutinates the glass fibers with each other in the fiber glass wet-laid nonwoven. The dryer unit may, for example, be a flow heater or a cylinder dryer or drying conveyor, whereby the fiber glass nonwoven is generally subjected to a temperature of 100 to 250° C., however not for longer than 1 to 2 minutes. Lastly, the fiber glass nonwoven which has a basis weight range of 40 to 200 g/m$^2$ and a binding agent component of 10 to 30% is wound onto winding cores in a winder, resulting in wound rolls in order to then be delivered to subsequent converting or processing stations.

Transfer of the wet and not yet conglutinated fiber glass nonwoven from the binder wire section into the dryer section occurs by means of a roll which is longitudinally corrugated, chrome plated and equipped with its own drive. Here, there is the ever present danger that the roll, when it comes into contact with the very wet fiber glass wet-laid nonwoven which, because of the binding agent application, is very sticky, will very quickly be contaminated with glass fibers. This contamination causes a very high production loss and inherent poor runability since the machine must be completely shut down and the roll which is contaminated with glass fibers must be cleaned. Occasionally, constructions incorporating "Online" roll cleaning are utilized, however the achievable cleaning results both in regard to achievable cleaning quality as well as required cleaning times is very unsatisfactory. Also, the costs associated with such constructions are considerable, not the least of which is necessity to keep a spare roll.

With the current production speeds of up to 350 m/min the roll is also not indexed, since this is not necessary for these production speeds. It is, however, recognized that the fibrous web consisting of the fiber glass wet-laid nonwoven experiences an "unsettled" run in this transfer area, thereby representing a possible hindrance for a future increase in production speeds.

What is needed in the art is an improved suction device of the type referred to at the beginning which largely, for example totally, avoids the cited disadvantages of the current state of the art. Especially the transfer of the wet fibrous web which is not yet conglutinated from the binder wire section into the dryer unit is to be configured process-reliably so that it does not negatively influence the runability of the machine and does not represent a hindrance for a future increase in production speeds.

SUMMARY OF THE INVENTION

The present invention provides a machine for the production of a fibrous web, for example a long-fiber paper web or a wet-laid nonwoven web, including a fibrous stock suspension unit for the production of an aqueous suspension of all components, a web former for dewatering the aqueous suspension and for forming the fibrous web and which includes at least one inclined wire progressing, at least in sections, at an angle to the horizontal and at least one single layer, for example multi-layer, headbox, one binder wire section to apply an aqueous binding agent onto the fibrous web which includes, at least in sections, a binder wire which progresses horizontally or approximately horizontally and which includes at least one binder headbox; one drying unit including one drying wire to dry and strengthen the fibrous web and one winder for continuously winding the fibrous web onto winding cores into wound rolls.

In the machine according to the present invention, at least one adjustable blowing device is provided between the binder wire section and the drying unit for contactless floating guidance of the fibrous web by means of air or another free flowing gaseous medium, whereby the blowing device is equipped with a plurality of blowing zones in a direction transverse to the direction of travel of the fibrous web which can be controlled/adjusted independently from each other. The provision of this blowing device for contactless flowing guidance of the fibrous web permits a process-reliable production of a fibrous web, for example a long-fiber paper or wet-laid nonwoven web.

Due to the provision of a floating cushion by the blowing device, the possibility of contamination of a component or a component group is largely, even totally avoided. Since possible cost and time intensive cleaning activities with demanding cleaning equipment is eliminated, considerably higher runability and lower operating costs of the machine can be advantageously achieved.

The floating cushion produced by the blowing device also assures a significant stabilization of the fibrous web in the transfer area, which in the end can act positively upon an increase in the production speeds. And the aforementioned blowing zones, which can be independently controlled/adjusted in transverse direction to the direction of travel of the fibrous web, allow an optimum and efficient operation of the blowing device across the width of the fibrous web.

In a first embodiment of the machine according to the present invention, the blowing device includes a housing extending at least across the width of the fibrous web which is connected to at least one blower, for example at least one controllable/adjustable blower, to produce a floating cushion and which includes a separation wall whose outer wall surface progresses curved as a guide surface for the fibrous web, and includes a plurality of discharge openings for the air or the other free flowing gaseous medium. This ensures a floating as well as stabilizing handling of the fibrous web around the outer periphery of the housing. Due to the targeted formation of the air cushion, for example based on the prevailing blower output and/or the selected curvature of the outer wall surface as the guiding surface for the fibrous web, a targeted influence upon the handling of the fibrous web can be exercised.

The discharge openings for the air or the other free flowing gaseous medium are located, for example, at least in one row, transversely to the direction of travel of the fibrous web so that a uniform formation of the air cushion occurs, as well as a simultaneous or approximately simultaneous treatment of the fibrous web with air or other free flowing gaseous medium. The discharge openings for the air or other free flowing gaseous medium may be arranged in two rows transversely to the direction of travel of the fibrous web, whereby the first row of discharge openings is provided in an air duct located in an area on the infeed side of the housing and the second row of discharge openings is provided in an air duct located in an area on the outgoing area of the housing and whereby the discharge openings provided in the air ducts are oriented toward a center plane of the housing. Through this the fibrous web experiences air treatment over a greater area.

In addition, a cover plate may be provided in the infeed area of the housing and/or the outgoing area of the housing which extends from the housing in the direction of the fibrous web and ends at a distance of between approximately 5 and 30 mm, for example approximately 10 and 25 mm, from the fibrous web and reaches essentially across the entire width of the fibrous web. This helps to ensure that the fibrous web runs smoothly, in other words without fluttering, onto the guide surface of the blower device and leaves it in the same mode. One reason for this is that the cover plate leads to a stabilization of the air flow, thereby preventing fluttering of the fibrous web. The cover plate may be fastened to the housing and/or may be adjustable in the direction of the fibrous web. Both of these options allow for adaptation to varying operational conditions.

In regard to an optimum positioning of the blowing device, it may—in its operating position—have an adjustment range compared to from the horizontal of approximately +50 to −80 mm, for example of +30 to −50 mm, or of approximately +20 to −30 mm. Therefore, it can more or less be adjusted into the progression of the fibrous web which is to be transferred, thereby being able to achieve a process-reliable handling of the fibrous web.

So that the floating cushion can be produced in sufficient size, the blowing device, which includes a plurality of independently controllable/adjustable blowing zones, has an air volume flow rate in the range of approximately 20 to 300 $m^3$/min·m, for example 30 to 250 $m^3$/min·m, or of approximately 50 to 200 $m^3$/min·m, and/or an air pressure in the range of approximately 0.02 to 3.0 bar, for example approximately 0.05 to 2 bar.

In addition, the blowing device can be positioned between the operating position and an inoperative position by at least one positioning device, for example by at least one pivoting mechanism. This allows for easy accessibility to the blowing device and its components.

Also, the machine and the blowing device, which is provided between the binder wire section and the drying units, are designed for a fibrous web having a width in the range of approximately 2,000 to 6,000 mm, for example approximately 3,000 to 6,000 mm, or approximately 4,500 to 6,000 mm and for a maximum production speed of up to approximately 600 m/min. In this width range, the process-reliable stabilization of the fibrous web comes to fruition.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
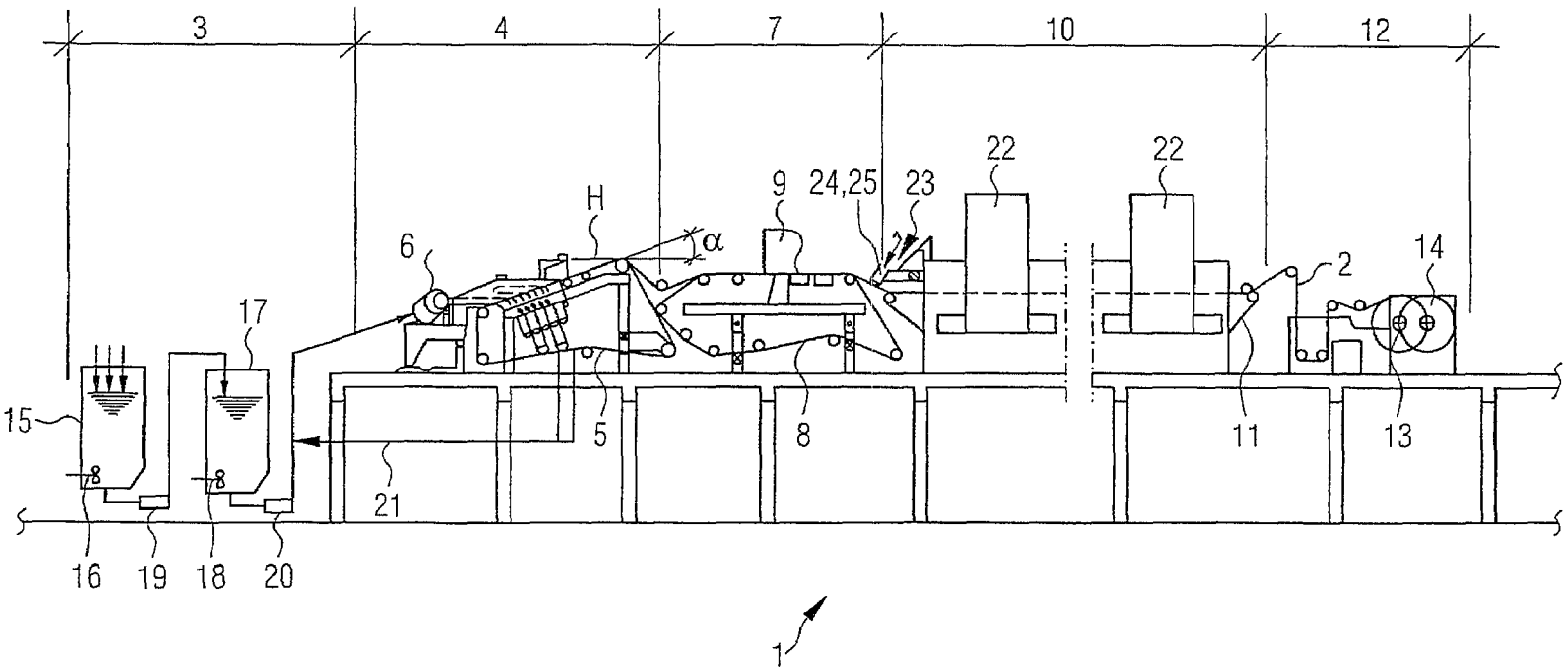
FIG. 1 is a schematic layout of a machine for the production of a fibrous web according to the current state of the art.

Referring now to the drawings, and more particularly to FIG. 1, there is shown a schematic layout of machine 1 for the production of fibrous web 2, for example a long-fiber paper web or a wet-laid nonwoven web.

Machine 1 for the production of fibrous web 2 includes fiber stock suspension unit 3; web forming unit 4 which includes at least one inclined wire 5 progressing at least in sections at an angle $\alpha$ to horizontal H and at least one single layer, for example multi-layer headbox 6; one binder wire section 7 which includes, at least in sections binder wire 8 which progresses horizontally or approximately horizontally and which includes at least one binder headbox 9; one drying unit 10 including one drying wire 11; and one winder 12 for continuously winding fibrous web 2 onto winding cores 13 into wound rolls 14.

In fibrous stock suspension unit 3, all components required to produce an aqueous suspension, for example water, chopped fibers, binding agents, etc. are put into first container (pulper) 15 which is equipped with agitator 16, and subsequently into second container (pulper) 17 which is also equipped with agitator 18; transport of the aqueous suspension is assumed by pumps 19, 20. The aqueous suspension may, for example, be a fiber glass slurry including glass fibers having a length in the range of approximately 6 to 40 mm, for example approximately 8 to 30 mm, or 10 to 25 mm, and so-called whitewater, and which has a fiber concentration of approximately 0.2 to 1.0 weight percent.

Fibrous stock suspension unit 3 is followed by the next process step—dewatering of the aqueous suspension and formation of fibrous web 2 with the assistance of inclined wire 5 which is located in web formation unit 4. For this purpose, the aqueous suspension is brought onto inclined wire 5 by means of one at least single layer, for example multi-layer headbox 6. The water filtered from the aqueous suspension below inclined wire 5 is circulated back according to arrow 21 and is added, for example, to the fibrous stock suspension leaving second container (pulper) 17 of fibrous stock suspension unit 3.

In the following process step, at least one aqueous binding agent, for example an aqueous urea-formaldehyde(UF)-resin based binding agent, is applied by means of binder headbox 9 onto still wet fibrous web 2 which is disposed on binder wire 8 of binder wire section 7. The excess binding agent is then sucked off in binder wire section 7 in a known manner. The aqueous binding agent may also be applied onto the still wet fibrous web by means of a curtain coater or dip- or squeeze applicator. Other application methods, such as spraying are also suitable.

The next process step is drying and strengthening of still wet fibrous web 2 through hardening (polymerization) of the binding agent which conglutinates the fibers in the fiber glass nonwoven with each other. For this purpose, it is passed through drying unit 10 which includes drying wire 11 and includes two illustrated heated flow heaters 22 or a cylinder dryer or belt dryer which are not illustrated. Here, fibrous web 2 is generally subjected to a temperature of approximately 100 to 250° C., however not for longer than approximately 1 to 2 minutes.

In a last process step, the fibrous web, which has a base weight range of approximately 40 to 200 g/m$^2$ and a binding agent component of approximately 10 to 30%, is wound in winder 12 onto winding cores 14 into wound rolls 13, in order to be then delivered to a subsequent converting or processing station.

Between binder wire section 7 and drying unit 10, schematically shown adjustable blowing device 23 is provided for contactless floating guidance of fibrous web 2 by means of air or another free flowing gaseous medium 25 which incorporates several independently controllable/adjustable blowing zones 26.1 through 26.5 (compare FIG. 5) in lateral direction to the direction of travel L (arrow) of fibrous web 2.

Figure 2:
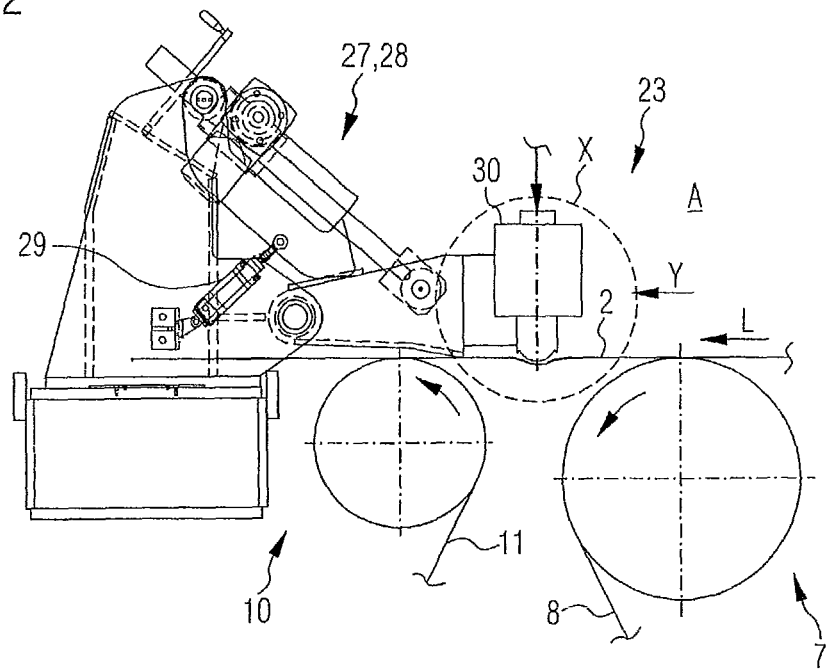
FIG. 2 is a schematic side view of an inventive blowing device in its operating position located between the binder wire section and the drying unit.
Figure 3:
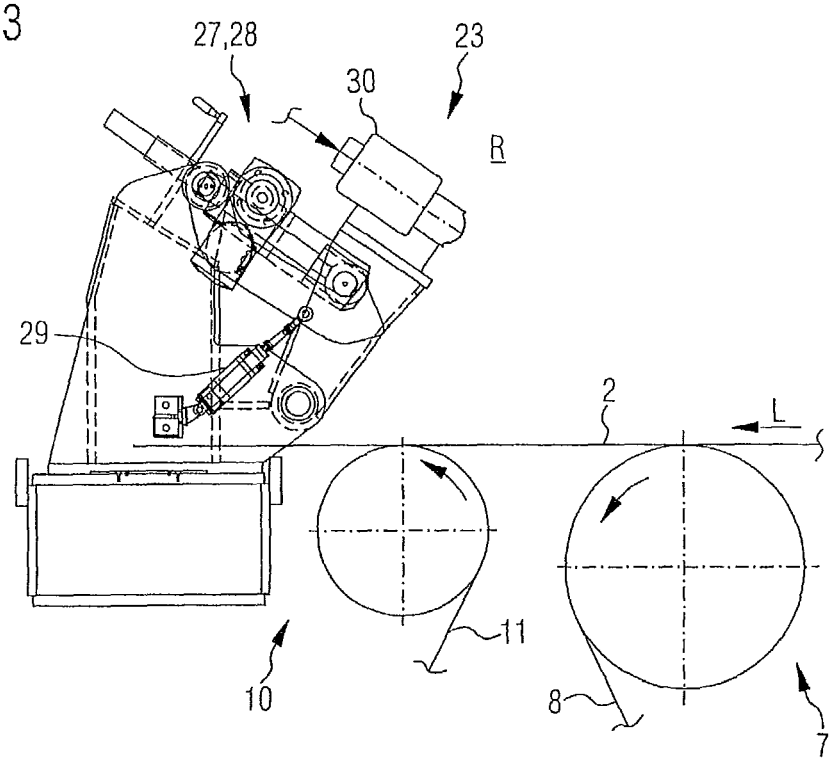
FIG. 3 is a schematic side view of an inventive blowing device in its inoperative position located between the binder wire section and the drying unit.

Referring now to FIG. 2, there is shown a schematic side view of blowing device 23 in its operating position A, located between binder wire section 7 and drying unit 10. In contrast, FIG. 3 shows blowing device 23 in its inoperative position R. Positioning of blowing device 23 between operating position A and inoperative position R is by at least one positioning device 27. Positioning device 27 in the embodiment of pivoted mechanism 28 is hinged at drying unit 10 as well as blowing device 23 which includes housing 30. Pivoted mechanism 28 of this type, for example, includes hydraulic or pneumatic pivoting cylinder 29. Fibrous web 2 has a direction of travel L (arrow) and binder wire section 7 includes binder wire 8, whereas drying unit 10 includes dryer wire 11.

Figure 4:
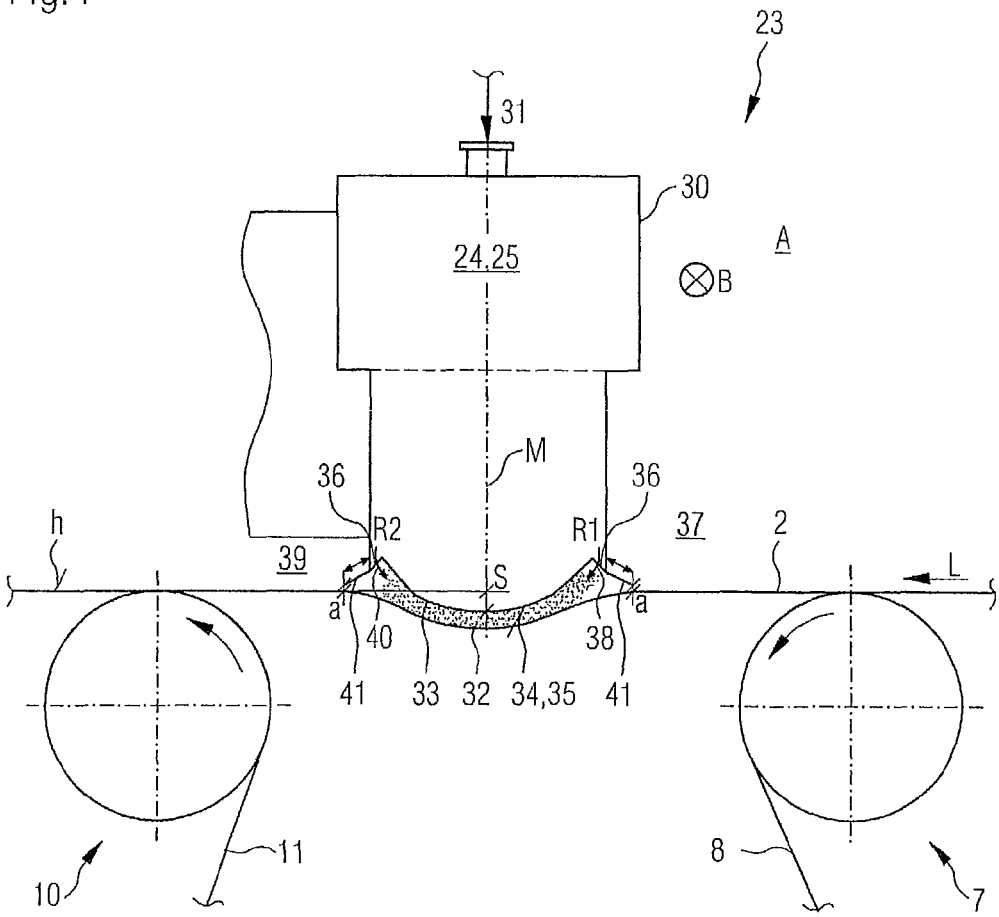
FIG. 4 is the blowing device illustrated in FIG. 2 in its operating position according to the detail X.

Referring now to FIG. 4, there is shown blowing device 23 according to detail X, illustrated in FIG. 2 in operating position A.

Blowing device 23 includes housing 30 which extends at least across width B (arrow) of fibrous web 2 and which may be connected to at least one controllable/adjustable blower 31 (arrow illustration) to produce floating cushion 32. It further includes separation wall 33 whose outer wall surface 34 progresses curved as guide surface 35 for fibrous web 2, and includes a plurality of discharge openings 36 for air 24 or other free flowing medium 25. Discharge openings 36 can be in the form of simple bores, but can also be equipped with nozzle inserts.

Discharge openings 36 for air 24 or other free flowing medium 25 are arranged in two rows R1, R2 transversely to the direction of travel L of fibrous web 2, whereby first row R1 of discharge openings 36 is provided in air duct 38 located in area 37 on the infeed side of housing 30, and second row R2 of discharge openings 36 is provided in air duct 40 located in area 39 on the outgoing area of housing 30 and whereby discharge openings 36 provided in air ducts 38 are oriented toward center plane M of housing 30.

In addition, cover plate 41 is located in infeed area 37 of housing 30, as well as respectively in outgoing area 39 of housing 30 which extends from housing 40 in the direction of fibrous web 2 and ends at a distance of between approximately 5 and 30 mm, for example approximately 10 and 25 mm, from fibrous web 2 and reaches essentially across entire width B of fibrous web 2. Individual cover plate 41 is fastened to housing 30 and is movable in a direction toward fibrous web 2. The respective movement is indicated by double arrow.

Blowing device 23, in its illustrated operating position A, has adjustment range S from the horizontal h of approximately +50 to −80 mm, for example of approximately +30 to −50 mm, or of approximately +20 to −30 mm. Therefore, it can more or less be adjusted into the progression of the fibrous web which is to be transferred, thereby being able to achieve a process-reliable handling of the fibrous web.

Also, blowing device 23 (compare FIG. 5) which includes a plurality of independently controllable/adjustable blowing zones 26.1 to 26.5 has, for example, an air volume flow rate V (arrow) in the range of approximately 20 to 300 m$^3$/min·m, for example approximately 30 to 250 m$^3$/min·m, or approximately 50 to 200 m$^3$/min·m, and/or an air pressure p in the range of approximately 0.02 to 3.0 bar, for example approximately 0.05 to 2 bar.

Figure 5:
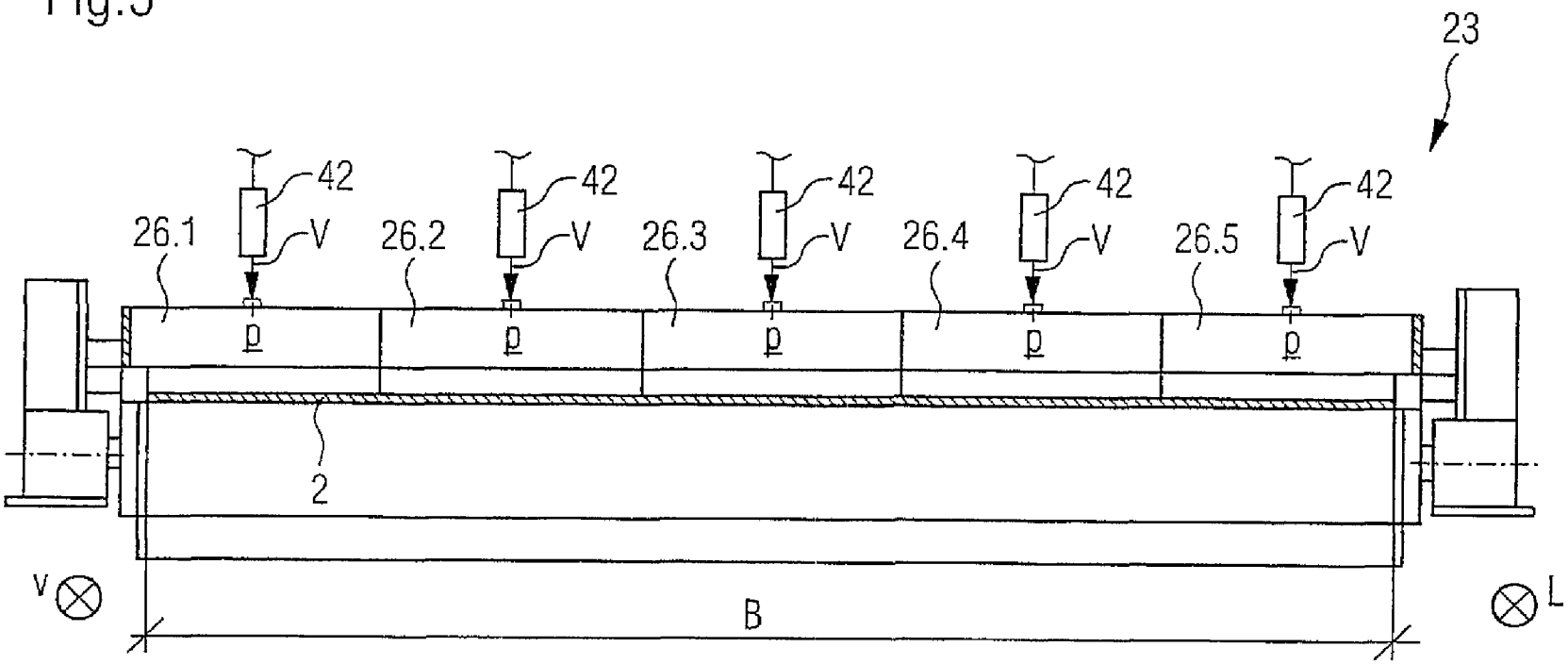
FIG. 5 is the blowing device illustrated in FIG. 2 in its operating position according to the detail Y.

Referring now to FIG. 5, there is shown blowing device 23 illustrated in FIG. 2 in its operating position A according to the detail Y;

Blowing device 23 which incorporates five independently controllable/adjustable blowing zones 26.1 to 26.5 is designed, for example, for fibrous web 2 having width B in the range of approximately 2,000 to 6,000 mm, for example approximately 3,000 to 6,000 mm, or approximately 4,500 to 6,000 mm and for a maximum production speed of up to approximately 600 m/min.

Air flow rate V (arrow), as well as pressure p in individual independent blowing zones 26.1 to 26.5, is controllable/adjustable through appropriate devices 42 which are merely indicated and which are known in the art.

Machine 1 illustrated in FIGS. 1 through 5 is suitable, for example, for the production of a long-fiber paper web or a wet-laid nonwoven web. The respective web can have, for example, a basis weight range of approximately 40 to 200 g/m$^2$, respective fiber lengths in a range of approximately 6 to 40 mm, or approximately 8 to 30 mm, or approximately 10 to 25 mm and a binding agent component of approximately 10 to 30%.

In summary, it can be stated that the present invention provides an improved suction device which largely, or even completely, avoids the disadvantages of the current state of the art. The transfer of the wet fibrous web which is not yet conglutinated from the binder wire section into the dryer unit is configured process-reliably so that it does not negatively influence the runability of the machine and does not represent a hindrance for a future increase in production speeds.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Machine
2 Fibrous web
3 Fibrous stock suspension unit
4 Web forming unit
5 Inclined wire
6 Headbox
7 Binder wire section
8 Binder wire
9 Binder headbox
10 Drying unit
11 Drying wire
12 Winder
13 Winding core
14 Wound roll
15 Container (Pulper)
16 Agitator
17 Container (Pulper)
18 Agitator
19 Pump
20 Pump
21 Arrow
22 Flow heater
23 Blowing device
24 Air
25 Medium
26.1 to 26.5 Blowing zone
27 Positioning device
28 Pivoted mechanism
The 29 Pivoted cylinder
30 Housing
31 Blowing device (arrow illustration)
32 Floating cushion
33 Segregation wall
34 Outer wall surface
35 Guide surface
36 Discharge opening
37 Infeed side area
38 Air duct
39 Outgoing area
40 Air duct
41 Cover plate
42 Device
A Operating position
a Distance
B Width (arrow)
H Horizontal
h Horizontal
L Direction of travel (arrow)
M Center plane
p Air pressure
R Inoperative position
R1 Row
R2 Row
S Adjustment range
V Air flow rate (arrow)
v Production rate (arrow)
X Detail
Y View
α Angle

What is claimed is:

1. A machine for the production of a fibrous web, the machine comprising:

a fibrous stock suspension unit for the production of an aqueous suspension;

a web former for dewatering said aqueous suspension and forming the fibrous web, said web former including at least one inclined wire progressing at least in sections at an angle to horizontal and a headbox including at least one single layer;

a binder wire section for applying an aqueous binding agent onto the fibrous web, said binder wire section progressing substantially horizontally and including at least one binder headbox;

a drying unit including a drying wire for drying and strengthening the fibrous web;

a winder for continuously winding the fibrous web onto winding cores into wound rolls;

at least one blowing device positioned between said binder wire section and said drying unit for contactless floating guidance of the fibrous web using a free flowing gaseous medium, wherein said blowing device includes a plurality of blowing zones transverse to a direction of travel of the fibrous web, said blowing zones being configured to be at least one of controlled and adjusted independently of each other.

2. The machine for the production of a fibrous web according to claim 1, wherein the fibrous web is one of a long-fiber paper web and a wet-laid nonwoven web.

3. The machine for the production of a fibrous web according to claim 1, wherein said headbox including at least one single layer is a multi-layer headbox.

4. The machine for the production of a fibrous web according to claim 1, wherein said blowing device includes a housing extending across a width of the fibrous web, said housing being connected to at least one blower to produce a floating cushion, said housing including a separation wall having an outer wall surface which progresses curved as a guide surface for the fibrous web, said separation wall including a plurality of discharge openings for one of said air and said other free flowing gaseous medium.

5. The machine for the production of a fibrous web according to claim 4, wherein said discharge openings are arranged in at least one row transversely to said direction of travel of the fibrous web.

6. The machine for the production of a fibrous web according to claim 5, wherein said discharge openings are arranged in two rows transversely to said direction of travel of the fibrous web, said two rows including a first row of said discharge openings in a first air duct located in an area on an infeed side of said housing and a second row of said discharge openings in a second air duct located on an area on an outgoing side of said housing, said discharge openings being oriented toward a center plane of said housing.

7. The machine for the production of a fibrous web according to claim 6, further comprising a cover plate on at least one of said infeed area of said housing and said outgoing area of said housing, said cover plate extending from said housing in a direction of the fibrous web and ending at a distance of between approximately 5 mm and 30 mm from the fibrous web and reaching substantially across said width of the fibrous web.

8. The machine for the production of a fibrous web according to claim 7, wherein said cover plate extending from said housing in said direction of the fibrous web ends at a distance of between approximately 10 mm and 25 mm from the fibrous web and reaches substantially across said width of the fibrous web.

9. The machine for the production of a fibrous web according to claim 8, wherein said cover plate is fastened to said housing.

10. The machine for the production of a fibrous web according to claim 9, wherein said cover plate is adjustable in said direction of the fibrous web.

11. The machine for the production of a fibrous web according to claim 1, wherein said blowing device has an operating position, said blowing device in said operating position having an adjustment range from horizontal of approximately +50 to −80 mm.

12. The machine for the production of a fibrous web according to claim 11, wherein said blowing device in said operating position has an adjustment range from horizontal from approximately +30 to −50 mm.

13. The machine for the production of a fibrous web according to claim 12, wherein said blowing device in said operating position has an adjustment range from horizontal from approximately +20 to −30 mm.

14. The machine for the production of a fibrous web according to claim 13, wherein said blowing device includes a plurality of blowing zones configured to be independently controlled and adjusted and having an air volume flow rate in a range of approximately 20 to 300 $m^3$/min·m.

15. The machine for the production of a fibrous web according to claim 14, wherein said blowing device has an air volume flow rate in a range of approximately 30 to 250 $m^3$/min·m.

16. The machine for the production of a fibrous web according to claim 15, wherein said blowing device has an air volume flow rate in a range of approximately 50 to 200 $m^3$/min·m.

17. The machine for the production of a fibrous web according to claim 13, wherein said blowing device has said operating position and an inoperative position, said blowing device being positioned between said operating position and said inoperative position by at least one positioning device.

18. The machine for the production of a fibrous web according to claim 17, wherein said at least one positioning device is at least one pivoting mechanism.

19. The machine for the production of a fibrous web according to claim 1, wherein said blowing device having said plurality of blowing zones configured to be at least one of controlled and adjusted has an air pressure in a range of approximately 0.02 to 3.0 bar.

20. The machine for the production of a fibrous web according to claim 19, wherein said blowing device having said plurality of blowing zones configured to be at least one of controlled and adjusted has an air pressure in a range of approximately 0.05 to 2 bar.

21. The machine for the production of a fibrous web according to claim 1, wherein the machine is configured for a fibrous web having a width in a range of between approximately 2,000 to 6,000 mm.

22. The machine for the production of a fibrous web according to claim 21, wherein the machine is configured for a fibrous web having said width in a range of between approximately 3,000 to 6,000 mm.

23. The machine for the production of a fibrous web according to claim 22, wherein the machine is configured for a fibrous web having a width in a range of between approximately 4,500 to 6,000 mm.

24. The machine for the production of a fibrous web according to claim 23, wherein the machine is configured for a maximum production speed of up to approximately 600 m/min.

* * * * *